United States Patent [19]

Taub

[11] Patent Number: 4,583,308

[45] Date of Patent: Apr. 22, 1986

[54] DISPLAY FLAG FOR PRICE LABEL AND INVENTORY CONTROL

[75] Inventor: Ronald H. Taub, Highland Park, Ill.

[73] Assignee: Taub Family Trust U/A

[21] Appl. No.: 567,817

[22] Filed: Jan. 3, 1984

[51] Int. Cl.[4] ..... G09F 1/00

[52] U.S. Cl. ..... 40/124.4; 40/19.5; 248/220.4

[58] Field of Search ..... 40/19.5, 21 A, 534, 40/124.4; 402/71; 248/220.3, 220.4, 221.1

[56] References Cited

U.S. PATENT DOCUMENTS

| | | | |
|---|---|---|---|
| 3,912,084 | 10/1975 | Valiulis | 248/220.4 |
| 4,394,909 | 7/1983 | Valiulis et al. | 248/220.3 |
| 4,463,510 | 8/1984 | Windish | 40/2 R |

FOREIGN PATENT DOCUMENTS

| | | | |
|---|---|---|---|
| W083/03319 | 9/1983 | PCT Int'l Appl. | 40/2 R |

*Primary Examiner*—Gene Mancene
*Assistant Examiner*—Cary E. Stone
*Attorney, Agent, or Firm*—Michael G. Berkman

[57] ABSTRACT

A multi-purpose, adjustable and deformable, self-supporting, ribbon-like band serving both as a display flag for price label, product information, and inventory code use, and also as a protective shield for covering an article-supporting rod or bracket carried by and extending from a peg-board-like panel. A tab assembly at a projecting free end of the band includes a record tag or label adapted to carry thereon visual indicia providing selectable product information.

1 Claim, 8 Drawing Figures

DISPLAY FLAG FOR PRICE LABEL AND INVENTORY CONTROL

BACKGROUND OF THE INVENTION

The present invention relates to a merchandising display flag. More particularly, the invention is directed to a display flag finding special utility for use in conjunction with peg-board-mounted arms or brackets of the type used to support articles for display and for selection and removal by purchasers.

Many different types of merchandise display devices have been promoted including those specially adapted for attachment to wall panels of the peg-board type. A commonly used structure for supporting an array of packaged articles for display and for retrieval by the purchaser, constitutes an arm or bracket, or hanger attachable to perforated panels by means of hook-like spaced fingers or horns insertable to extend through the preformed openings in the panel itself.

It is highly desirable that articles offered for sale in a supermarket or the like be clearly marked with the current price as well as with certain inventory information and codes. Maintaining the price marking current poses problems. Retailers are somewhat reluctant to affix prices to the individual articles themselves, since prices periodically change, necessitating corresponding correction in the marked amounts. Moreover, item-by-item price marking is itself time consuming and costly. Changing the price marking on ganged articles which are slideably arrayed on a hanger or rod poses even more challenging problems.

A further problem generated through the use of outwardly projecting brackets or rods is a continuing danger of injury, including facial injuries or eye injuries to persons who may accidently walk into the display assembly, or who may otherwise inadvertently come into contact with the projecting end of the rod.

Accordingly, it is to an effective and simple resolution of the above and other problems that the present invention is directed.

SUMMARY OF THE INVENTION

The present invention comprises a multi-purpose adjustable and deformable self-supporting ribbon-like band serving both as a display flag for price label, product information, and inventory code use, and also as a protective shield covering an article-supporting rod or bracket carried by and extending from a peg-board-like panel. A related feature of the display flag of the invention is that it includes a tab assembly at an outwardly projecting free end of the band. This tab assembly includes a record tag or label adapted to carry thereon visual indicia providing selectable product data and information.

It is a related feature of the display flag of the invention that the tag or label of the tab assembly is simply and readily replaced or corrected to show the current price of the article involved or to provide the latest inventory and other data.

In a preferred embodiment of the invention, the display flag constitutes a flexible, self-supporting, resilient and metastable elongated band which is simply and conveniently adjustable for length and for physical orientation.

Another feature of the band constituting a major structural component of the display flag of the invention is that the band is formed with an array of opening means or openings for selectively receiving therethrough paired hook-like ends or horns of article-supporting brackets to be mounted on a supporting peg-board-like panel.

Yet another feature of the ribbon-like band of the display flag of the invention is that the band itself is scored or demarked to define a plurality of segmental sections, the band being foldable, selectably, at any preferred section demarcation line to establish a preferred angled configuration in the band itself, facilitating attachment to a vertical panel while concurrently ensuring projection of the ribbon-like band forwardly and essentially normally of that support panel and along the support bracket.

A related practical feature of the ribbon-like band of the display flag assembly of the invention is that the overall length of the band may be conveniently modified by severing from the band any preferred number of segmental sections, thereby to produce a shortened band specially adapted for a particular application and environment.

It is an important feature of the invention that the display flag assembly may be attached to the supporting peg-board and selectively oriented to define any of a plurality of precise configurations, each related to and correlated with a selectable spacial relationship to the hanger-bar and to the articles supported thereon.

In a preferred embodiment of the invention, the ribbon carries at an outwardly extending free end thereof a tab assembly which includes means for selective recordation thereon of product-related inventory, pricing data, and reference information.

A related feature of the invention is that the tab assembly includes, in a preferred embodiment of the invention, label securement means by which a tag or label may be secured by the tab assembly for convenient viewing of indicia displayed thereby.

In one preferred embodiment of the invention the band is so oriented as to lie in a generally horizontal plane in a bracket-bridging mode to extend along a projecting expanse of the bracket, with a tab assembly end portion of the band disposed forwardly and in front of a terminal end of a rod of the bracket to shield the rod end from inadvertent contact with persons who may accidently come "too close" to the bracket.

In a second but related mode of securement, the band is disposed to lie in a generally vertical plane while extending alongside the bracket and parallel thereto and spaced laterally therefrom. Again, the band serves as a protective device to prevent inadvertent personal physical contact with the projecting end of the bracket itself.

It is a related feature of the ribbon-like band of the invention that it is foldable selectively to establish a predetermined effective length of the forwardly extending component of the band, that length being correlated with the length of the article-supporting bracket itself.

It is a feature of the invention that in its final attached form, the band assumes a generally L-shaped configuration, the back-wall portion or section of the structure being secured to a supporting peg-board by means of the fingers of the bracket itself, these fingers projecting through hole defining means in the band and into the prepunched openings in the peg-board. In the final physical arrangement described, the article-supporting probes or arms of the bracket serve the dual function of supporting the bracket and the bracket-carried articles, and, also, securing the ribbon-like display flag of the invention in place.

An aesthetic feature of the invention is that the back-wall-mounted section of the band is effectively hidden from view by the overlying array of displayed articles supported on the bracket.

A related feature of the invention is that in its preferred embodiment, the ribbon-like band is fabricated of a transparent plastic so that the band itself poses no impediment to the visual display of the articles offered for sale.

In a preferred embodiment of the invention, the tab assembly includes label or tag means for displaying the current price of those articles supported on the display bracket. Thus, in the event of a change in price, or in any other relevant parameter, it is necessary merely to make the single change on the information-carrying tag supported by the tab assembly, obviating a tedious and time-consuming change in price or other information on each of the display articles themselves.

Yet another feature of the display flag of the invention is that it provides a relatively permanent location identification for the placement of articles on each of the support brackets in conncection with which the device is used.

It is a feature of the display flag of the invention that it takes up no additional room and requires no additional attachment or mounting fixtures.

A practical day-to-day advantage of the display flag of the invention is that it simplifies the task of reordering, and inventory control.

The unique merchandising device of the present invention is simple in construction and economical in fabrication.

Other and further features, advantages and objects of the invention will be apparent from the following description considered in conjunction with the drawings.

DESCRIPTION OF PREFERRED EMBODIMENTS

Figure 1B:
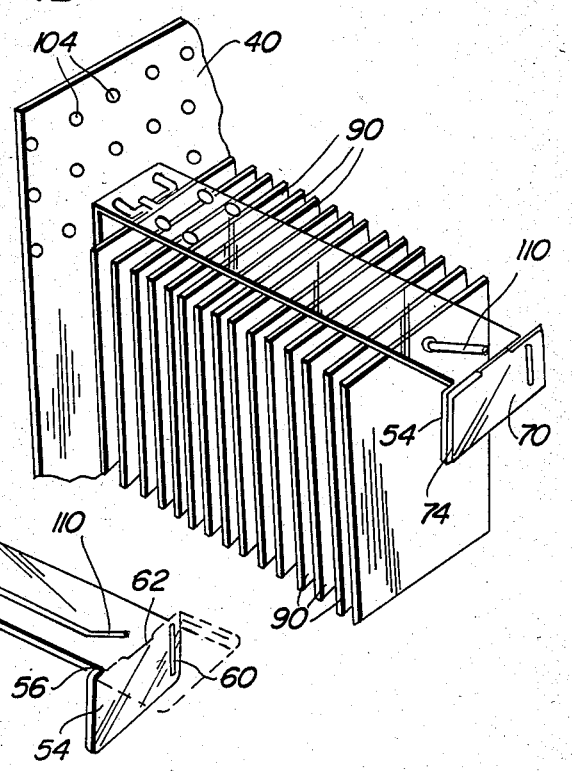
FIG. 1B is a perspective view indicating schematically the display flag of the invention oriented to overlie a supporting-hanger rod fastened to a peg-board and carrying an array of items displayed for sale, and also showing, at a forward end of the display flag, a tab assembly presenting a planar vertical face for convenient viewing of indicia displayed thereby.

The aims and objects of the invention are accomplished by providing, as a merchandising device, a multi-purpose, adjustable and deformable self-supporting ribbon-like band serving both as a display flag for price, label and product information, and inventory code and control use. Additionally, the physical form of the display flag renders it a protective shield effectively covering the outwardly extending or projecting end of an article supporting rod or bracket of the type used in conjunction with a peg-board panel as a means for displaying an array of articles offered for purchase. A tab assembly at the outwardly extending extremity of the display flag is adapted to carry product-related inventory information, pricing data, and additional product identification information. In its preferred embodiment, the display flag of the invention is adapted for ready accommodation and use in various modes or attitudes including as a band overlying the supporting bracket and also as a band projecting generally alongside the bracket which serves as the flag support means. Preferred embodiments of the display-flag assembly of the invention are fabricated of semi-rigid, self-supporting plastic, preferably transparent, the elongated ribbon-like band being segmented and demarked to facilitate the selective adjustment as to length and ultimate configuration.

Additionally, the band is premarked or prescored to delineate the punch outs or openings used in conjunction with the prong-like fingers of the brackets assembly, which fingers constitute the means by which the assembly is engaged to be supported on the peg-board or peg-board-like panel.

Referring more particularly to the drawing, there are shown, for the purpose of illustrative disclosure and not in any limiting sense, preferred embodiments of the display flag assembly of the invention incorporating the teachings thereof. As shown in FIG. 1, the display flag assembly 20 comprises an elongated ribbon-like band 24 of a flexible and resilient, substantially self-supporting positionally-metastable material, preferably plastic. In the specific preferred embodiment of the assembly shown, the band 24 is demarked by transverse score lines or indentations 28 providing a linear array of segments 30, the band 24 being foldable or bendable along any selectable transverse demarcation line 28. The latter is used in converting the band 24 into a generally L-shaped configuration as shown in FIG. 1A to facilitate securement of the assembly 20 on a vertically extending support panel 40 or similar structure, such as a peg-board, to which the display flag 20 is attached in use.

Figure 1:
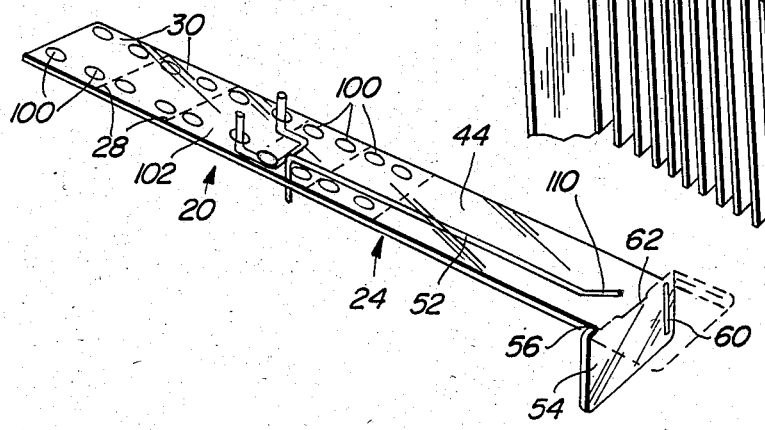
FIG. 1 is a perspective view of a display flag according to the invention, indicating schematically one optional arrangement in which the display flag overlies the articles or packages displayed and overlies the supporting, rod-like bracket.
Figure 1A:
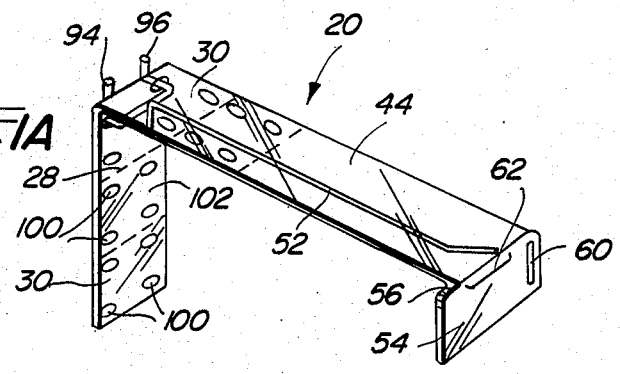
FIG. 1A shows the assembly of FIG. 1 with the "extra" segmental sectors of the multi-sector display flag bent out of the way to project downwardly, thus facilitating attachment of the flag-supporting rod to the peg-board-type panel.

As shown schematically in FIGS. 1A and 1B, the ribbon-like band 24 is selectably adjusted as to the length of its principal arm 44 so that the latter accommodates the length of the bracket or rod assembly 50 including a bar or rod 52 which the main body portion 44 of the band assembly 20 overlies. At its forwardly presented end, the principal arm 44 of the band 20 is integrally formed with a tab 54 which is foldable or bendable downwardly along a prescored line 56 so that the tab projects generally normally of the plane of the arm 44. In the preferred embodiment of the invention depicted, the tab 54 is provided with slots 60 and 62 for accommodating an optional top web or cover plate 70 (FIG. 1B) by means of which a removable indicia-carrying card 74 is removably secured in place for ready viewing. The cover plate 70 is formed with a pair of wings or ears 80 and 82 for mating engagement respectively with the slots 60 and 62 for securing the cover plate 70 in position to overlie the tab 54.

Referring further to FIGS. 1, 1A, and 1B, and as best seen in FIG. 1A, the display flag 20 of the invention is secured in place by the bracket or rod assembly 50 which is carried by the peg-board panel 40 and supports the articles or packets 90 to be displayed for purchase. In effecting the securement of the display flag 20, the rearwardly and upwardly projecting mounting hook elements 94 and 96 of the bracket 50 are inserted through a selectable pair of prescored or prepunched cooperating openings 100 in a selectable segmental sector 30 of a second arm 102 of the band 24 and then inserted into cooperating corresponding spaced holes or openings 104 in the peg-board panel 40. It will be understood that in the embodiment of the invention depicted in FIGS. 1-lB, the rod 52 of the bracket assembly 50 lies beneath to extend along the undersurface of the principal body portion 44 of the display flag assembly 20. In the physical arrangement described, it will be seen that the outwardly projecting end 110 of the rod 52 is mechanically shielded by the overlying band 44 and the depending skirt or tab 54, thus preventing inadvertent or accidental contact with persons approaching the display assembly.

Although the display flag assembly 20 as described above overlies and protectively shields the hanger bracket assembly 50 including the projecting end 110 of the rod 52, the flag assembly 20 being flexible and resilient is readily and easily temporarily displaced during sequential removal of a displayed packet 90 by any person electing to purchase such items. Thus, the display flag 20 of the invention serves its intended function without any substantial interference with either the promotional display or the endwise sequential removal of articles offered for sale.

Figure 2:
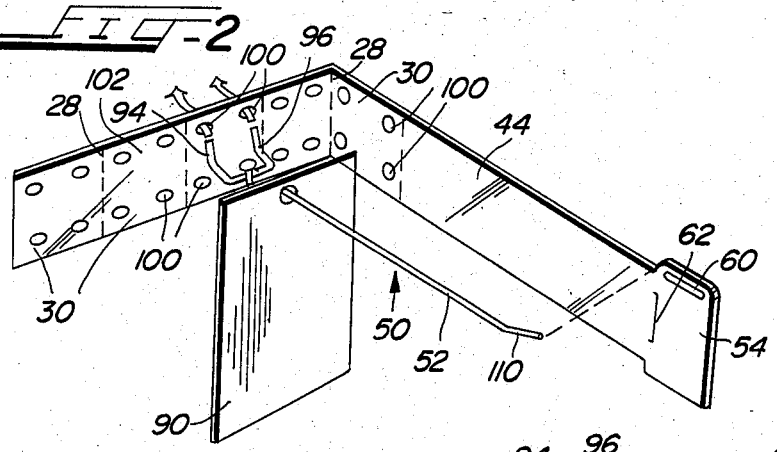
FIG. 2 is a perspective view similar to FIG. 1 but showing the display flag of the invention disposed to extend alongside rather than to overlie a display-flag-securing, peg-board-engaging, article-supporting bracket.
Figure 2B:
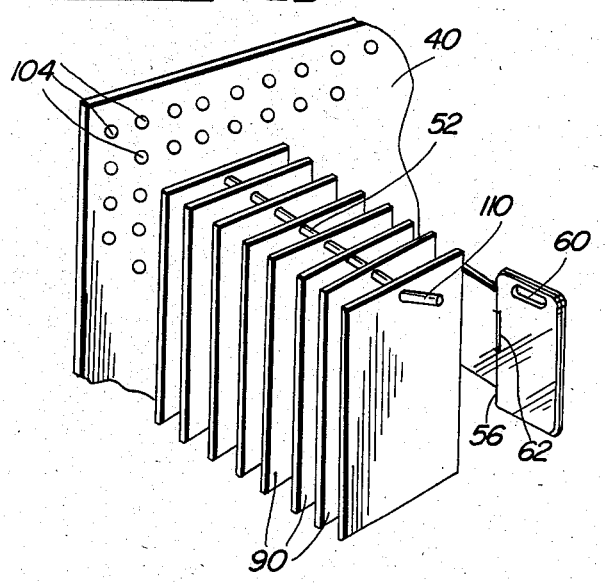
FIG. 2B is a perspective view similar to FIG. 1B but with the body of the display flag in a vertical plane and extending alongside a supporting article-carrying bracket.
Figure 2A:
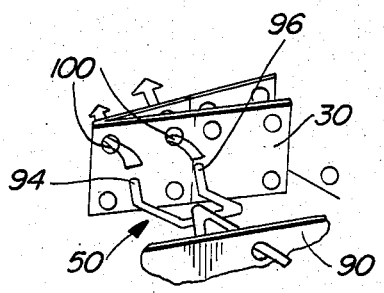
FIG. 2A shows a detail in which excess end sectors of the segmental display flag are folded over prior to inserting the prongs of the flag-supporting bracket through cooperating punch outs in the plastic band-like display flag.

Referring now to FIGS. 2, 2A, and 2B, there is shown an alternative mode for utilization of the display-flag assembly 20 of the invention. As seen in FIG. 2, the display assembly 20 of the invention is oriented so that the principal body portion 44 extends laterally of and generally parallels the arm 52 of the hanger bracket 50 which secures the display flag assembly to the supporting peg-board 40. The transverse dimension of the band 24 is so oriented that it extends in a generally vertical plane. Preferably, the length of the principal arm 44 of the display assembly 20 is so adjusted that the terminal tab 54 extends somewhat beyond the free end 110 of the hanger arm 52, as indicated schematically in FIG. 2. Thus, the display flag assembly 20 again serves as a "protective" device to prevent inadvertent contact between the projecting end 110 of the hanger arm 52 and a passerby. As in the first arrangement described, the elongated band 24 of the display flag 20 of the invention is folded along a selectable, preformed scoreline 28 to establish the desired length of the principal body portion 44. The residual length 102 of the band extends normally of the principal body portion 44 and along the mounting panel 40.

The manner of securement of the display flag 20 of the invention to the peg-board or mounting panel 40 is illustrated schematically in FIG. 2. As shown, the hooks or prongs 94 and 96 of the hanger bracket 50 are inserted through a pair of selectable openings 100 in a selectable segment 30 of that portion 102 of the band 24 which overlies the peg-board 40, and the prongs 94 and 96 are then inserted into holes 104 in the peg-board itself. If desired, and as indicated schematically in FIG. 2A, the board-mounted portion 102 of the band 24 extending along and overlying the peg-board 40 may be folded upon itself along a preformed groove 28,in registry, to provide a double thickness of band through which the hooks 94 and 96 of the bracket arm 50 are then inserted. Following the procedure previously described, an information or indicia-carrying card 74 may be secured to the tab 54 by means of an overlying cooperative web or second tab 70. The latter is removably attached to the principal tab 54 by means of wings 80 and 82 which are removably inserted into cooperating slots 60 and 62 at edges of the principal tab 54. Again, since the tabs 54 and 70 are transparent, selectable information and indicia may be imprinted on each of opposed sides of the card 74 and readily read from either side of the display assembly 20. When it is desired to modify or change the information carried by the card 74, it is necessary merely to remove the card and to replace with a substitute or modified card.

Figure 3:
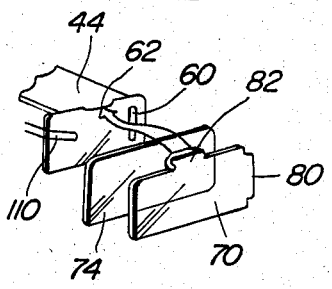
FIG. 3 is a detail indicating schematically the manner of securing an overlay flap in place in the end tab assembly arrangement of FIG. 1.
Figure 4:
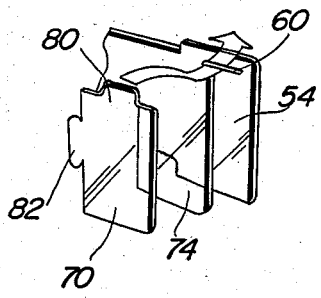
FIG. 4 is a detail similar to FIG. 3 but indicating the manner of securing an overlay flap element in the end tab assembly of FIG. 2.

FIGS. 3 and 4 indicate, schematically, the manner in which the indicia-carrying card 74 is secured in a sandwich-like disposition between the interlocked cooperating tabs 54 and 70.

From the foregoing description it is evident that the subject invention provides a simple yet highly effective technique and apparatus which serves the dual function of shielding or protecting the arm of the hanger assembly without impairing the ease with which the displayed articles are removed from the hanger arm. Additionally, the display flag of the invention provides a simple and highly effective means by which important information including price information and inventory and stock data may be readily displayed without the necessity of imprinting or marking such information on each of the specific articles being offered for sale. It is also readily apparent that the change or modification of the information carried by the display is accomplished simply and readily, as required from time-to-time.

While the disclosure is of preferred embodiments of the invention, and while there have been provided descriptions of preferred methods and materials for assembly and fabrication of the display assembly of the invention, it is apparent that numerous modifications and variations in structural detail, materials, and in manufacturing techniques may be made without departing from the underlying principles of the invention. It is, therefore, desired by the following claims to include within the scope of the invention all such variations and modifications by which substantially the results of this invention may be obtained through the use of substantially the same or equivalent means.

What is claimed is:

1. A display flag for price label, product information, and inventory code use, said display flag being selectively mountable in each of two orientational modes, and comprising:

an elongated, flexible and resilient, substantially self-supporting, positionally-metastable, ribbon-like band, said band being formed with a plurality of spaced hole-defining means for receiving in substantial registry therethrough ends of cooperating mating prong-like panel-engaging and mounting hook elements of a rod-like hanger bracket, said hole-defining means including spaced holes in said band for facilitating mounting of said band selectively to project in each of two different orientational modes, said modes including a bracket-bridging first mode in which said band extends in a genrally horizontal plane along a projecting expanse of the bracket, and in which said band overlies the bracket along a lineal expanse of a panel-engaging, panel-supported hanger bracket arm on which articles may be arrayed for promotional display and for end-wise sequential removal, and a second mode in which said band lies in a vertical plane and extends laterally of and generally parallel to a bracket projecting outwardly of and generally normally to a supporting panel, band-shortening and band-orientation means for selectively reducing the overall extending length of said band, and for angling said band to orient and to facilitate functional attachment of said band to a wall structure, said band-shortening and orientation means including score lines extending transversely across said band for defining a series of lineally- disposed segments, said score lines delineating said segments and constituting fold lines by means of which a selectable, predetermined number of band segments may be pivotally shifted to extend angularly, indicia-carrying tab means adjacent an outwardly presented zone of said band and integrally formed with sand band for selective recordation of project related information thereon including inventory, pricing data, and product reference information, said tab means being formed with first and second slot means for securing a cover panel hingedly to overlie said tab means in substantial areal corresponding therewith, said slot means including first and second slots disposed at marginal edge portions of said tab means and at right angles to one another in said tab means, said first of said slots extending transversely of said band adjacent a junction of said terminal zone of said band with said tab means, and said second of said slots being formed in an end zone of said tab means and said second of said slots being formed in an end zone of said tab means and paralleling an end edge thereof, cover panel means for hinged securement to overlie said tab means, said cover panel means having an areal configuration corresponding to that of said tab means for congruent superimposition thereover, said cover panel means including integrally formed wing means extending from a pair of edges of said cover panel means, said edges being disposed normally of one another, said wing means defining first and second wings positioned and oriented for selectively engaging in mating interlocking engagement within corresponding said first and said second slots formed in said tab means to secure said cover panel means in hingedly overlying relationship with said tab means in each of said orientation modes of said band.

* * * * *